US005285911A

United States Patent [19]

Altherr

[11] Patent Number: 5,285,911

[45] Date of Patent: Feb. 15, 1994

[54] COUPLER KNUCKLE PIN PROTECTOR STRUCTURE AND STRESS RELIEVER

[76] Inventor: Russell G. Altherr, 8449 Moraine Ave., Munster, Ind. 46321

[21] Appl. No.: 935,201

[22] Filed: Aug. 26, 1992

[51] Int. Cl.[5] ..... B61G 3/04

[52] U.S. Cl. ..... 213/152; 213/155

[58] Field of Search ..... 213/113, 152, 155

[56] References Cited

U.S. PATENT DOCUMENTS

| | | | |
|---|---|---|---|
| 2,548,479 | 4/1951 | Kayler | 213/152 |
| 3,097,751 | 7/1963 | Henricot | 213/152 |
| 4,640,422 | 2/1987 | Elliott | 213/155 |
| 4,976,363 | 12/1990 | Altherr | 213/155 |
| 5,145,076 | 9/1992 | Murphy et al. | 213/155 |

*Primary Examiner*—Robert J. Oberleitner
*Assistant Examiner*—S. Joseph Morano
*Attorney, Agent, or Firm*—Fred P. Kostka

[57] ABSTRACT

A railway vehicle coupler including a coupler body and a knuckle rotatable about a vertical axis. A stress relieving bracket extends integrally from the coupler body and engages the knuckle in bearing relationship between upper and lower pivot connections mounting the knuckle for pivotal movement on the body. The stress relieving bracket when in bearing relationship with knuckle serves to transfer stresses from the knuckle to the coupler body during train operation.

6 Claims, 2 Drawing Sheets

COUPLER KNUCKLE PIN PROTECTOR STRUCTURE AND STRESS RELIEVER

BACKGROUND OF THE INVENTION

The present invention relates to railway couplers and more particularly to railway couplers of the type having rotatable knuckles which are operative to swing or rotate about a vertical axis into a locked position to interconnect adjoining railway cars and having an improved structure for relieving the stresses imposed on interacting elements including the coupler pin.

Rotatable knuckle type of couplers are exemplified by the American Association of Railroads (AAR) type E and F couplers. These couplers are used extensively throughout the world and include a coupler housing having upper and lower laterally extending pivot lugs. The pivot lugs are each provided with axially aligned openings and pin protector bosses which embrace opposite ends of knuckle pin about which the knuckle pivots between a coupler locked and unlocked position. In the locked position the knuckle is inter-engaged with a coupler knuckle of an adjacent railway car and it rotates to the unlocked position to release the cars from each other.

In recent years the load carrying capacity of the railway cars has been materially increased. As for example, in coal hauling cars. High stresses occur in the coupler at the pulling lugs, pivot lugs and pin protectors. Such stress causes wear to occur in the bearing surfaces of these elements and of the pin ends journaled in the pivot lugs and the associated pin protector bosses projecting from the lugs. Wear at the bearing surfaces of the pulling lugs and pin protectors permits the knuckle to translate forwardly within the coupler head and to apply shear and bending forces to the knuckle pin and the associated pin mounting structure. The design of the knuckle pin and associated mounting structure is such that it cannot be relied upon to adequately transmit and distribute the pulling forces to the coupler body.

It is an object of the present invention to provide increased bearing contact area between the knuckle and coupler head within the existing envelope to more uniformly distribute the stresses and thereby obviate the difficulties encountered heretofore.

SUMMARY OF THE INVENTION

By the present invention it is proposed to provide an improved knuckle and coupler housing structure which overcomes the difficulties encountered heretofore by providing means for increasing the bearing area between the knuckle and coupler body. More particularly, the improved coupler structure includes means for transmitting a portion of the pulling forces of the knuckle to the coupler body or housing at a location remote from the present pivot lugs on which the knuckle pin is mounted.

To this end in one embodiment of the invention a coupler body lug may be provided intermediate the pivot lugs. The body lug has bearing surfaces that are complementary with the bearing surfaces of the body pulling lugs and pin protectors. In this manner pulling forces at the knuckle are transmitted to the coupler body at additional and more distributed bearing surfaces to reduce the unit stress and increase the assembly life.

Additional or alternatively stress relief from the pulling forces at the knuckle pin may be provided with means engageable and in bearing contact with the knuckle and the coupler body when the latter is in the locked position thereof. In the coupler released position the knuckle is disengaged from the stress relieving means so that the knuckle pin is supported for rotation by the pivot lugs.

DESCRIPTION OF THE PREFERRED EMBODIMENTS

Figure 1:
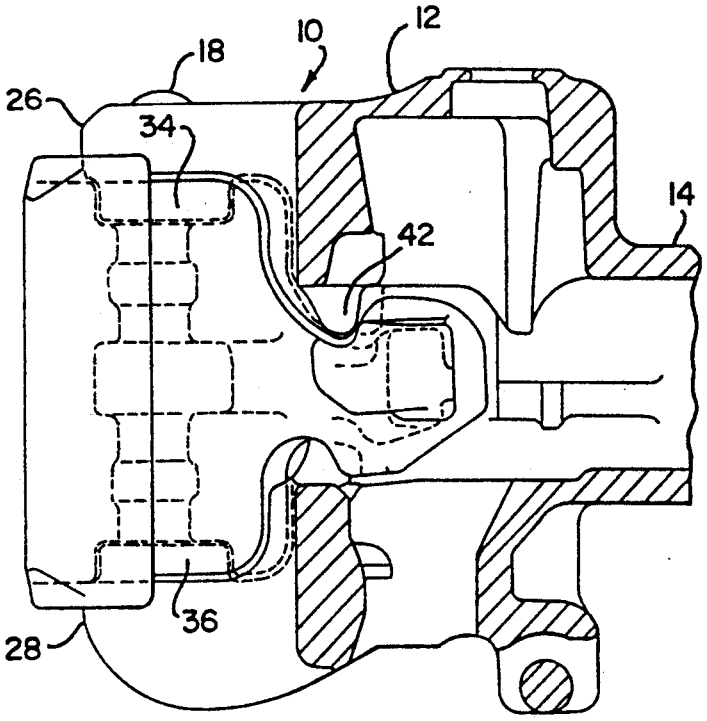
FIG. 1 is a fragmentary elevational view of a railway coupler partially in section and embodying the structure of the present invention.
Figure 2:
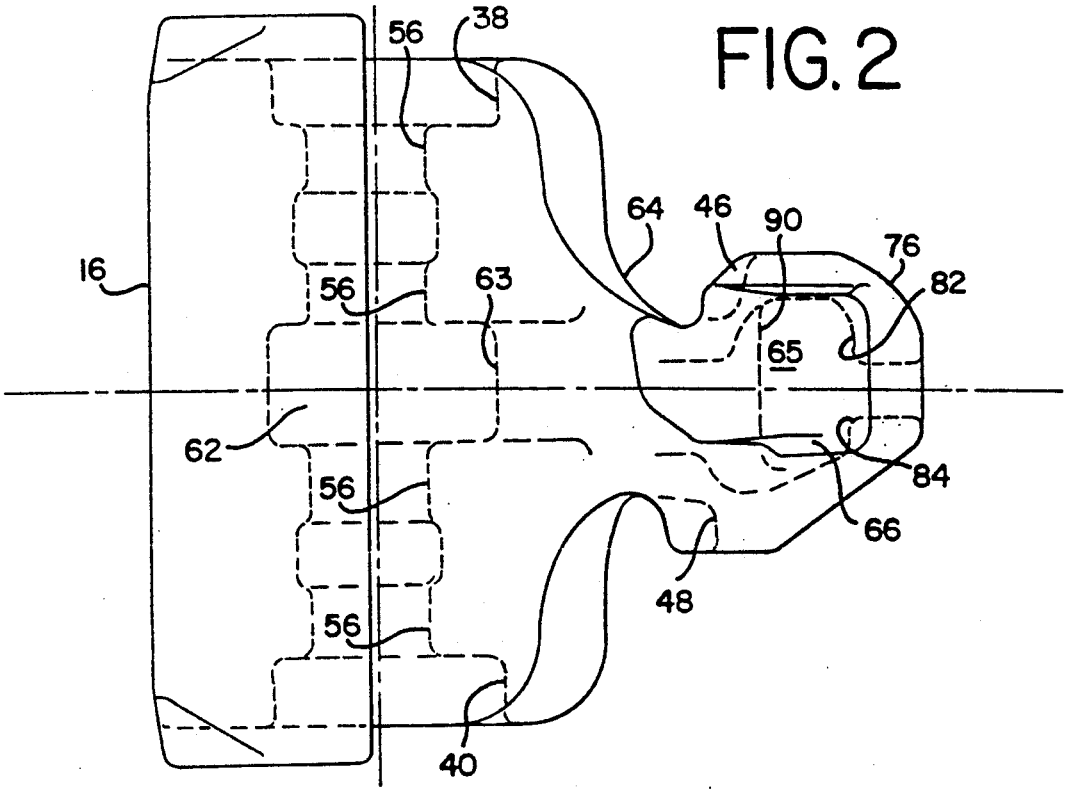
FIG. 2 is an elevational view of the knuckle shown in FIG. 1 and showing cavities to accept stress relieving brackets of the present invention.

Referring now to the drawings, the structure of the present invention is embodied in a coupler 10 of the type designated by the American Association of Railroads (AAR) as an E-Type coupler. The coupler comprising generally a coupler head or body 12 and a shank 14. The shank 14 is operatively connected to the end of a railway car center sill (not shown) by means of a draft gear and yoke (not shown). Mounted in the head 12 is a knuckle 16 which is turnable about a knuckle pivot pin 18 between an unlocked or release position and a latched or locked position. In the latched or locked position a locking mechanism (not shown) located in the coupler head 12 is operative to maintain the knuckle in a fixed interlocked position with a coupler knuckle on an adjacent railway car or vehicle. The locking mechanism may be of well known structure and is manually activated to allow the knuckle to rotate to a release position.

Figure 3:
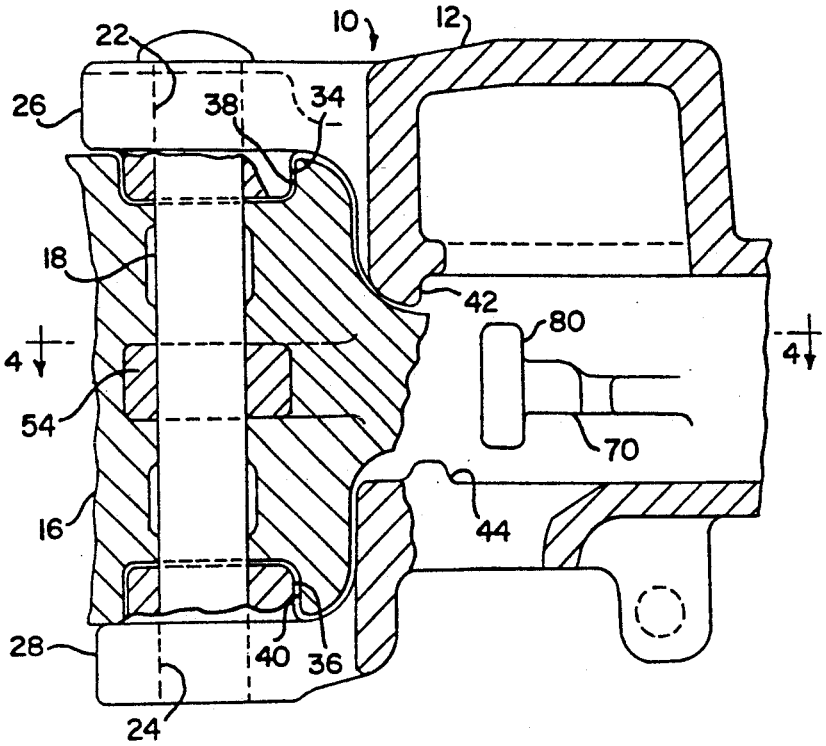
FIG. 3 is an elevational view partially in cross section showing the stress relieving structure operative on the coupler body, the knuckle and the knuckle pin for reducing the contact stresses and the knuckle pin stress.

As shown in FIGS. 1 and 3, the coupler head 12 contains laterally projecting pivot lugs 26 and 28 that have body pin protector bosses 34 and 36 projecting from the inner surfaces of the pivot lugs 26 and 28. Aligned oblong or round pin holes 22 and 24 extend through pivot lugs 26 and 28 and pin protector bosses 34 and 36.

The knuckle 16 is disposed between the body pin protector bosses 34 and 36 and has knuckle pin protectors 38 and 40 encapsulating three sides of the respective body pin protector bosses 34 and 36 to journal on them when rotating from release to locked position. A knuckle pin hole 56 is aligned with pin holes 22 and 24 when the knuckle is in the closed position and is retained in alignment in the release position by knuckle pin 18.

In the locked position as shown, the knuckle 16 is located such that pulling shoulders or lugs 42 and 44 in the coupler head are in engagement with corresponding pulling faces 46 and 48, respectively, on the knuckle 16.

When in the locked position upon the application of a pulling force the knuckle faces contact the body pulling lugs 42 and 44 to transmit the force to the coupler body without the necessity of imposing stresses on the pin 18 or its contact with the pivot lug holes 22 and 24 or the knuckle hole 56. When the couplers are subjected to constant and intermittent draft and buff forces wear tends to occur at the pulling lugs 42 and 44, and pulling faces 46 and 48, the pin protectors 34 and 36 and knuckle pin protector cavities 38 and 40, and some force can be transmitted by the knuckle pin hole 56, pin 18 and the pivot lug openings 22 and 24 journaling the ends of the pins 18. Such wear reduces the useful operating life of the coupler.

The aforementioned wear is reduced by the provision of means disposed between the upper and lower pivot lugs 26 and 28 on the head 12 so that forces transmitted to knuckle 16 are more uniformly distributed to the coupler body 12. This results in limiting a corresponding wear of the engaging surfaces at pivot lug holes 22 and 24, pin 18, knuckle pin hole 56, pin protectors 34, 36, 38 and 40, and the engaging pulling faces 46 and 48 of the knuckle and 42 and 44 of the coupler head 12.

Figure 4:
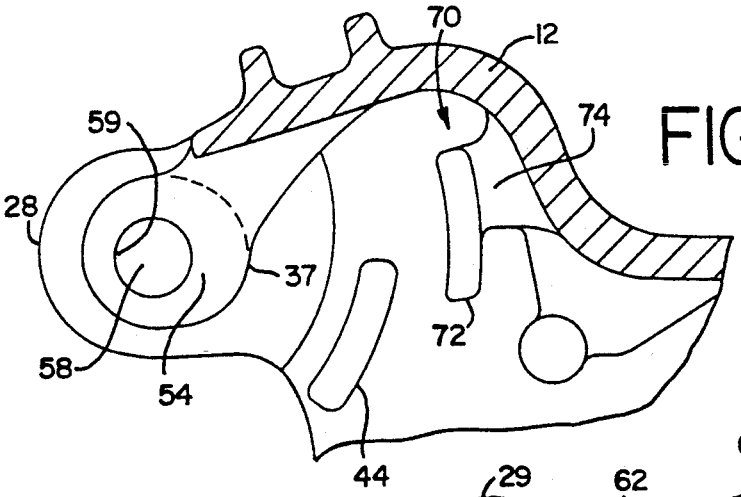
FIG. 4 is a cross-sectional view taken generally along the lines 4—4 of FIG. 3 but with the knuckle being removed to more clearly illustrate the stress relieving arrangements on the coupler head.

In one form of the invention as shown in particular in FIGS. 3 and 4, there is provided an intermediate bracket or a body lug 54 fixed at one end to the interior wall of the coupler head 12 on the knuckle side thereof intermediate pivot lugs 26 and 28. At the other or free end thereof the bracket or body lug 54 includes a bearing surface 37 that is aligned and shaped similar to pin protectors 34 and 36 and has a pin opening 58 having a bearing surface 59 approximately aligned with holes 22 and 24.

The bracket or lug 54 with the bearing surface 37 is accommodated in knuckle 16 by a horizontally disposed slot 62 having a bearing surface 63 that is aligned and shaped similar to knuckle pin protectors 38 and 40.

Extending from the knuckle hub 29 is a tail 64 having a locking face 65, a lock shelf 66, and the top and bottom pulling faces 46 and 48. The lock or coupler latching mechanism (not shown) is operative to retain the knuckle in the latched position in the well known manner by contact with locking face 65.

In the latched position the pulling lugs or faces 46 and 48 engage the body pulling lugs 42 and 44 so as to assume the forces transmitted during train operation from the knuckle tail 64 to the coupler body 12.

Figure 5:
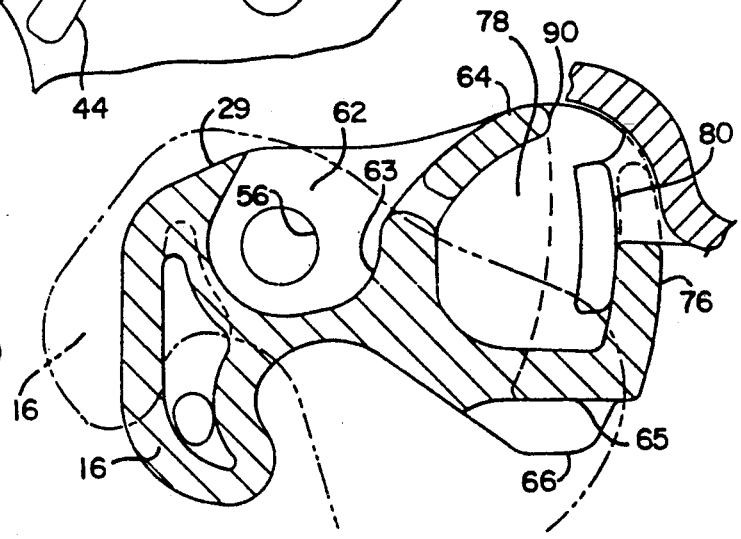
FIG. 5 is a cross-sectional view similar to FIG. 4 but showing the knuckle in the locked position and the interaction of the stress relieving arrangement at the knuckle tail.

In order to further reduce the stress at the head pulling lugs 42 and 44 and knuckle pulling lugs 46 and 48, there may be provided a knuckle tail engaging stress relieving assembly 70 as shown in particular in FIGS. 4 and 5. The knuckle tail engaging assembly 70 includes an upstanding plate 72 from which there projects a generally horizontally disposed connecting plate 74 which is fixed to the interior wall of the coupler head 12. The upstanding plate 72 and the connecting plate or lug 74 form in the nature of a T disposed in a horizontal attitude. The upstanding plate 72 enters knuckle tail cavity 78 through a knuckle tail opening 90 so that an outboard convexly contoured surface 80 of plate 72 abuts concave surfaces 82 and 84 of the upstanding wall 76 of tail cavity 78 when knuckle 16 is in the locked or latched position as shown. In this manner the forces between the knuckle tail 64 and the coupler head are shared by knuckle tail surfaces 46, 48, 82, and 84 in engagement with coupler head surfaces 42, 44, and 80. It is to be noted that the engagement of the stress relieving assembly and the knuckle occurs in the coupler latches position intermediate the pivot lugs 26 and 28.

When the locking mechanism is activated to a release position, the knuckle may be rotated clockwise as viewed from above to the knuckle open position by slidably disengaging head pulling lugs 42 and 44 from knuckle pulling lugs 46 and 48, surfaces 80 from 82 and 84, pin protectors 34 and 36 from cavities 38 and 40, and surface 63 from surface 37. In that knuckle open position, as in phantom lines in FIG. 5, removal of the knuckle pin 18 allows the knuckle 16 to be separated from the coupler 12.

It is to be noted that the intermediate bracket 54 and the knuckle stress relieving assembly 70 may be employed either singly in a coupler or in combination. Such application of the bracket 54 and assembly 70 may be determined by use in which the railway vehicle is to be placed.

The foregoing description and drawings explain and illustrate the best known mode of the invention and those skilled in the art who have the disclosure before them will be able to make modifications and variations herein without departing from the scope of the invention which is defined in the following claims.

What is claimed is:

1. A railway vehicle coupler comprising a coupler body, a knuckle mounting means including vertically spaced pivot lugs mounting said knuckle on said coupler body for movement about a vertical axis between a locked position and a release position, pulling lugs on each of said knuckle and said coupler body engageable when said knuckle is in said locked position, stress relieving means integral with said coupler body extending between said knuckle and said coupler body intermediate said pivot lugs for distributing stresses applied on said knuckle to said coupler body when said knuckle is in said locked position, wherein said stress relieving means comprises a plate means integral with said coupler body at one end and slot means in said knuckle accommodating said plate means, said other end of said plate means engaging said knuckle so as to alleviate said stresses.

2. The invention as defined in claim 1 wherein said mounting means for mounting said coupler includes a pivot pin journaled at each end in said pivot lugs, and said stress relieving means extending between said coupler body and said knuckle includes a hole having a bearing surface journaling said pivot pin intermediate its ends.

3. The invention as defined in claim 2 wherein said mounting means includes an inwardly protecting boss at each of said pivot lugs, said bosses having a bearing surface engaging knuckle bearing surface on said knuckle.

4. The invention as defined in claim 1 wherein said knuckle includes a knuckle tail disposed remote from said knuckle mounting means and intermediate said pivot lugs, and second stress relieving means projecting from said coupler body engageable with said knuckle tail in the locked position thereof for transmitting stresses imposed on said knuckle to said coupler body.

5. The invention as defined in claim 4 wherein said knuckle tail includes a slot, and a stress relieving lug of the body is disposed in said slot and engageable with a wall defining said slot, and said stress relieving lug is engageable with said wall in the locked position of said knuckle.

6. The invention as defined in claim 5 wherein said stress relieving lug is in an upstanding position and is connected to said coupler body by a substantially horizontally projecting plate.

* * * * *